US005884492A

United States Patent [19]

Zwicky et al.

[11] Patent Number: 5,884,492

[45] Date of Patent: Mar. 23, 1999

[54] AIR CONDITIONING SYSTEM AND METHOD FOR PROVIDING PRECISE PSYCHOMETRIC CONDITIONS IN AN AIR CONDITIONED SPACE

[75] Inventors: Henry Arnold Zwicky, Greensboro; Roger Harold Lamar, Winston-Salem; Allen James Bradley, Greensboro; Tony Gray Peele, Lexington, all of N.C.

[73] Assignee: AC Corporation, Greensboro, N.C.

[21] Appl. No.: 759,221

[22] Filed: Dec. 5, 1996

[51] Int. Cl.[6] ..... F25D 17/06

[52] U.S. Cl. ..... 62/91; 62/93; 62/171; 62/176.4; 62/176.6; 261/129; 261/36.1

[58] Field of Search ..... 62/171, 176.4, 62/176.6, 185, 201, 91, 93; 261/129, 24, 34.1, 36.1

[56] References Cited

U.S. PATENT DOCUMENTS

| | | | |
|---|---|---|---|
| Re. 20,944 | 12/1938 | Baker . | |
| 2,214,880 | 9/1940 | Crawford . | |
| 3,965,690 | 6/1976 | Berryhill . | |
| 4,230,670 | 10/1980 | Forseth . | |
| 4,312,189 | 1/1982 | Cotton, Jr. . | |
| 4,351,817 | 9/1982 | Slagel et al. . | |
| 4,399,864 | 8/1983 | Lamar . | |
| 4,604,108 | 8/1986 | Cotton, Jr. . | |
| 4,723,415 | 2/1988 | Chen . | |
| 4,857,090 | 8/1989 | Hartness | 62/171 X |
| 5,019,300 | 5/1991 | Davis et al. . | |
| 5,247,809 | 9/1993 | Berryhill . | |
| 5,368,786 | 11/1994 | Dinauer et al. . | |
| 5,497,628 | 3/1996 | Stueble | 62/171 X |

OTHER PUBLICATIONS

LUWA Industrial Air Conditioning Products, 1965 Pneumafil Corporation, Charlotte, North Carolina.

*Primary Examiner*—Henry Bennett
*Assistant Examiner*—Susanne C. Tinker
*Attorney, Agent, or Firm*—Rader, Fishman & Grauer

[57] ABSTRACT

An air conditioning system and method whereby water sprays are arranged and modulated in air washers from recirculated water and a cooled or non-cooled central water source to provide precise psychometric (dry bulb temperature, relative humidity, dew point temperature and specific humidity) conditions in the space being conditioned while conserving energy by reducing the cooling load, reducing the pumping horsepower load, and eliminating reheat under all weather conditions. This system also reduces maintenance and operating costs by allowing chemical treatment, makeup water, water overflow, and water filtration to be provided in a central location even with multiple air washers and water chillers.

21 Claims, 1 Drawing Sheet

AIR CONDITIONING SYSTEM AND METHOD FOR PROVIDING PRECISE PSYCHOMETRIC CONDITIONS IN AN AIR CONDITIONED SPACE

FIELD OF THE INVENTION

The present invention relates generally to air conditioning systems and, in particular, to an air conditioning system having air washers with modulating sprays using recirculated water and a central source of water to deliver precise psychometric conditions to a conditioned space while at the same time reducing energy usage and eliminating the need for reheat under all weather conditions.

BACKGROUND OF THE INVENTION

Conventional air washers introduce a constant amount of water spray into the air washer chamber to saturate the air supply leaving the air washer to approximately 95% relative humidity. Even with air washer bypass, heat is required when the sensible heat gain in the conditioned area drops below approximately 67% of its design heat load. Even when chill water is introduced on a separate bank of sprays or manifold together with recirculating water (see U.S. Pat. Nos. 3,965,690, 4,604,108 and 5,247,809), these conventional air washers still saturate the air supply to a fixed relative humidity, provide no means for throttling the recirculated water sprays to obtain a variable discharge relative humidity, and require heat to maintain desired conditions in a partially loaded space.

Air washers incorporating spray throttling techniques, such as those described in U.S. Pat. Nos. 4,089,666, 4,312,189 and 4,399,864, introduce chill water into the suction side of the recirculating water pump. During light load periods this requires minimum recirculating water sprays to maintain the desired psychometric conditions in the conditioned space. This in turn can produce an overcooling effect and require heat to maintain the desired space psychometric conditions. During periods when a substantial amount of outside air is required to maintain the desired air washer discharge dew point temperature and the outside air is humid, the air supply is saturated to a higher relative humidity than is desired and heat is required to dry it out.

Another problem that occurs when conventional or spray throttling air washers are connected to one chill water supply system is that during the winter months the chill water is turned off and each washer must operate independently. This means that a central chemical water treatment system does not function during this period. Automatic chemical feed systems installed on individual air washers are expensive. Owners often resort to manually feeding chemicals into each air washer which produces overfeeds or underfeeds and less than optimum results. Also the chill water piping interior is exposed to air and corrodes more during this period.

Conventional air washer controls with or without spray throttling capabilities utilize space temperature control to maintain the desired psychometric conditions in the conditioned space. In some instances, high limit humidistats are provided to override the space thermostats in the event that chill water is unavailable when it is needed. This does not provide consistent control of conditioned space relative humidity when chilled water is required but unavailable. It also uses more energy than necessary.

Air washers are used to condition spaces where precise psychometric conditions are required and where the internal sensible heat gain is usually much higher than the external heat gain. In most cases latent heat gain or loss in these spaces is negligible when compared with the sensible heat. However, there are several cases where this is not true. For example, when water jet looms are used in the textile industry, there is a large latent heat gain in the space that is uncontrollable. In northern climates during the winter time, where outside walls have inadequate vapor barriers there are large latent heat losses.

Traditional spray throttling air washer control systems compensate for space latent heat load changes by increasing or decreasing the recirculating water spray saturation. This provides overcooling or undercooling, poor control, and excessive use of heat.

SUMMARY OF THE INVENTION

The present invention is a new and novel way of supplying and throttling a central source of cooled or not cooled water common to one or more air washers in combination with throttling sprays of water recirculated through the air washer, and a control method to eliminate the need for minimum recirculated water and to eliminate the need for supplemental heat under any outside air conditions provided that the interior heat gains of the conditioned space are at least equal to the heat losses of the building perimeter.

More specifically, the present invention provides an air conditioning system and method whereby water sprays are arranged and modulated in air washers from recirculated water and a cooled or non-cooled central water source to provide precise psychometric (dry bulb temperature, relative humidity, dew point temperature and specific humidity) conditions in the space being conditioned while conserving energy by reducing the cooling load, reducing the pumping horsepower load, and eliminating reheat under all weather conditions. The system also reduces maintenance and operating costs by allowing chemical treatment, makeup water, water overflow, and water filtration to be provided in a central location even with multiple air washers and water chillers.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWING

The present invention will become more clearly appreciated as the disclosure of the invention is made with reference to the accompanying drawing.

A preferred embodiment of the invention is illustrated in the single FIG. 1, which is a diagrammatic representation of an air conditioning system embodying the present invention.

DESCRIPTION OF THE PREFERRED EMBODIMENT

Figure 1:
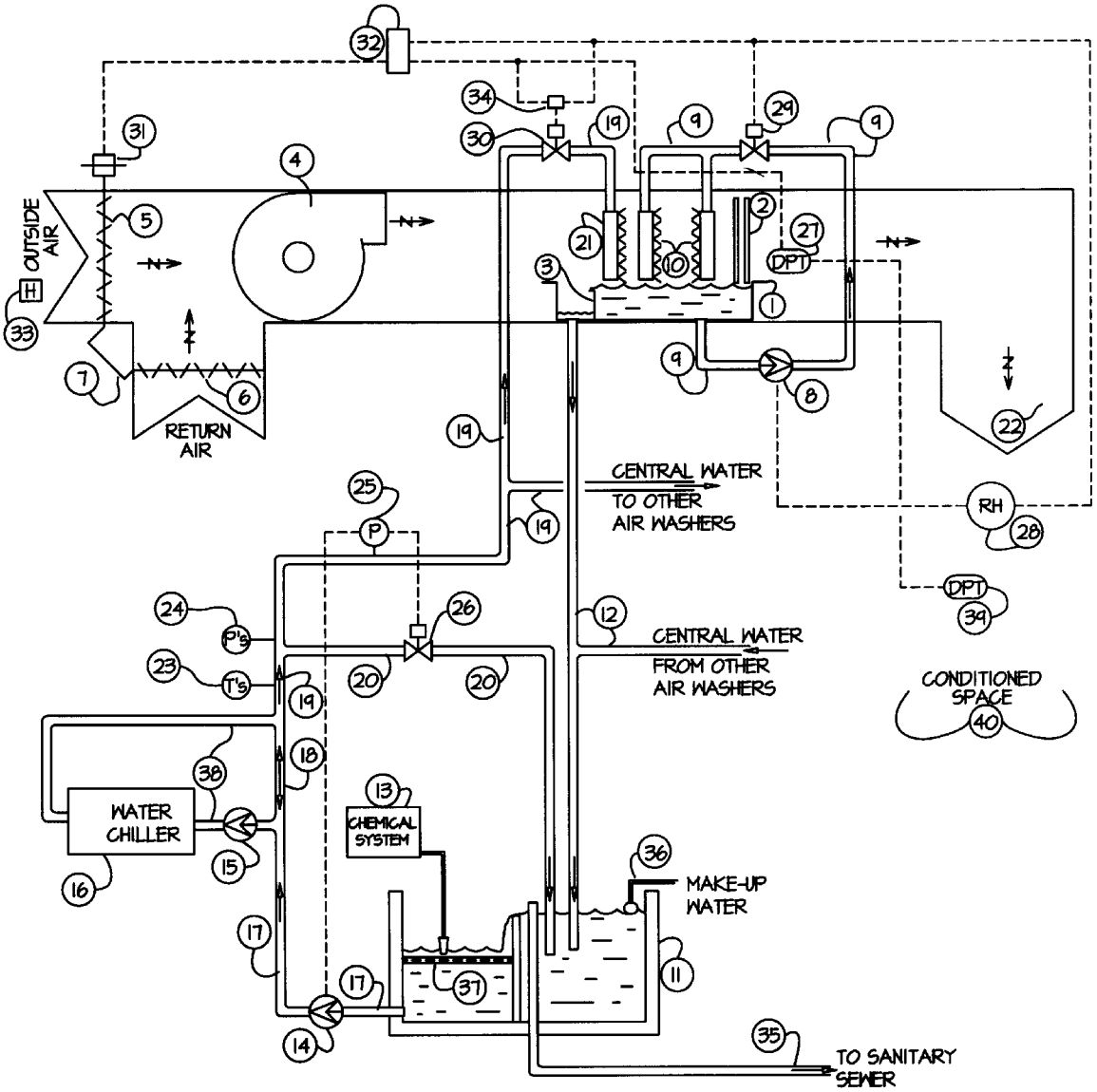

The present invention will now be described, by way of example, with reference to the accompanying FIG. 1.

The preferred embodiment of the invention diagrammatically illustrated in FIG. 1 includes an air conditioning system in which return air from a conditioned space is normally recycled, but may be mixed with outside air and passed through a washer to dissipate the heat added during its passage through the conditioned space. The air conditioning system includes an air washer 1 complete with a tank and remote and recirculating water handling capability, air washer water eliminators 2, and a water return weir 3 with a drain plug in the bottom of the weir or other suitable arrangement for returning and draining water from the air washer 1 to a central tank 11.

A supply air fan 4 or other means of transporting air through the air washer 1 either in a blow-through or draw-through arrangement is provided. Air is drawn into the supply air fan 4 through normally closed outside air control dampers 5 and normally open return air control dampers 6. An arrangement 7 is provided for linking the outside air control dampers 5 and return air control dampers 6 together.

A variable speed air washer recirculation water pump 8 is provided for delivering recirculated water through recirculation water piping 9 to the air washer 1.

A water spray system 10 comprising a header, a stand pipe and spray distribution nozzles is provided for spraying the recirculating water from the water piping 9 into the air washer 1. Although the water spray system 10 is shown as the second and third banks of sprays in the air flow, the water spray system 10 may actually be any bank(s) and deliver equal performance.

The central water tank 11 is supplied with return water from the air washers 1 through water return piping 12. A water treatment chemical system 13 complete with automatic controls is provided for distributing chemicals into the central water tank 11 or directly into a central water supply piping 19. At least one variable speed central water pump 14 is provided to deliver water from the central water tank 11 to the air washer 1 and all other connected air washers (not shown). At least one chill water pump 15 is provided to recirculate a constant amount of water through one or more water chillers 16. The water chillers 16 each have their own controls. Water supply piping 17 provides water from the central water pump 14 to the chill water pump 15. A common connection line 18 is provided from the central water piping system 17 and 19 to a chill water piping system 38. The central water supply piping 19 provides a means to deliver a central source of water to all connected air washers 1. A central water bypass piping 20 provides a bypass return from the central water supply piping 19 to the central water supply tank 11.

A water spray system 21 comprising a header, a stand pipe and spray distribution nozzles is provided for spraying water from the central water supply piping 19 into the air washer 1. Although the water spray system 21 is shown as the first bank of sprays in the air flow, the water spray system 21 can be positioned downstream of or in between the water spray system 10 and deliver equal performance.

A distribution duct 22 or other suitable means is provided to deliver treated air from the air washer 1 to the conditioned space 40.

A temperature sensor 23 is provided to determine whether water being delivered from the central water supply piping 19 to the air washers 1 is cold enough to dehumidify the air being treated by the air washers 1. A pressure sensor 24 or other suitable means is provided to determine whether the central water pump 14 is running. A pressure controller 25 is provided to control the pressure in the central water supply piping 19 going to the air washer 1 and other connected air washers (not shown). A by-pass control valve 26 is provided to relieve pressure in the central water supply piping 19 as determined by the pressure controller 25.

A dew point (specific humidity) controller 27 is located in the discharge air of the air washer 1. A relative humidity controller 28 is located in the conditioned space 40. A recirculating spray water control valve 29 is provided to modulate the water flow through the recirculation pipe 9 and the air water spray system 10.

A central water spray throttling control valve 30 is provided to modulate the water flow through the central water supply piping 19 into the water spray system 21. A damper actuator 31 is provided to modulate the normally closed outside air dampers 5 and the normally open return air dampers 6.

A low signal selector 32 is provided for allowing the conditioned space humidity controller 28 to override the signal from the dew point controller 27 to the damper actuator 31. While the low signal selector 32 is shown as a separate component, its function can be programmed into a system controller so that a separate physical structure for the selector 32 need not exist.

A sensor 33 or other suitable means is provided for comparing outside air enthalpy with return air or room enthalpy. A switch 34 is provided for switching the control signal to the central water spray throttling control valve 30 to determine whether the valve 30 is controlled by the dew point controller 27 or the relative humidity controller 28. While the switch 34 is shown as a separate component, its function can be programmed into a system controller so that a separate physical structure for the switch 34 need not exist.

The central water supply tank 11 is provided with a water overflow pipe 35, an automatic water make-up valve 36, and a water filter 37.

A sensor 39 is provided for sensing dew point temperature (specific humidity) in the conditioned space 40. The conditioned space 40 is the space in which precise psychometric conditions are desired and which typically contains heat producing objects, such as production machinery, process equipment, lights, people, and the like.

SEQUENCE OF OPERATION

When all of the supply fans 4 serving the air washers 1 connected to the central water supply pipe 19 are off, the central water pump 14 is off. When any supply fan 4 is on, the central water pump 14 is on and the water pressure controller 25 is allowed to operate. The supply fans 4 may be started and stopped manually or automatically.

When the supply fan 4 is off, recirculating water pump 8 is off, spray valve 29 (where required) is closed, spray valve 30 is closed, outside air dampers 5 are closed, and return air dampers 6 are open.

When the supply fan 4 is on the following sequence occurs.

On a rise in dew point temperature (specific humidity) above a selected set point, as sensed by the dew point temperature controller 27, the outside air dampers 5 modulate open while the return air dampers 6 modulate closed. On a further increase in dew point temperature, a signal is sent to start the water chiller 16 and chill water pump 15. On a further increase in dew point temperature, the central water spray throttling valve 30 modulates open to increase the water flow in the spray system 21, provided that the sensors 23 and 24 in the central water pipe 19 verify that central water supply pump 14 is operating and that the water in the central water supply 19 is cold enough to dehumidify the air stream in the air washer 1. The throttling valve 30 is modulated open by placing the switching valve 34 in a position so that the throttling valve 30 receives its signal from the dew point controller 27. When outside air enthalpy exceeds return air or room enthalpy, as sensed by the enthalpy controller 33, the output of the dew point controller 27 is overridden to fully close the outside air dampers 5 and to fully open the return air dampers 6. The opposite occurs on a decrease in dew point temperature (specific humidity) below the set point of the dew point controller 27.

On an increase in relative humidity above the set point of the conditioned space 40, the relative humidity controller 28 causes the recirculating water spray pump 8 to modulate slower until it turns off to reduce the water flow in the spray system 10. Alternately, if the recirculating water pump 8 cannot modulate slower, then the spray throttling valve 29 is controlled to reduce the water supply to the spray system 10. When the spray throttling valve 29 completely closes, the spray pump 8 turns off.

On a further increase in the relative humidity of the conditioned space 40, the central water spray throttling valve 30 modulates closed provided that the water sensors 23 and 24 verify that the central water pump 14 is operating and that the water in the central water supply piping 19 is not cold enough to dehumidify the air stream of the air washer 1. The switching valve 34 is placed in a position so that central water spray throttling valve 30 receives its control signal from the space humidity controller 28.

On a further increase in the relative humidity of the conditioned space 40, the outside air dampers 5 modulate closed while the return air dampers 6 modulate open. This is accomplished by the low signal selector 32 allowing conditioned space humidity controller 28 to override the signal from the dew point controller 27 to the outside air and return air damper actuator 31. The opposite occurs on a decrease in the relative humidity of the conditioned space 40 below the set point of the relative humidity controller 28.

As the central water spray throttling valve 30 closes on the air washer 1, and as the central water spray throttling valves (not shown) close on the other air washers (not shown) connected to the central water supply piping 19, the pressure in the central water supply piping 19 increases. On an increase in this water pressure above the set point of the pressure controller 25, a signal of the pressure controller 25 modulates the central water pump 14 slower to maintain its pressure. Alternately, if the central water pump 14 cannot modulate, then the pressure controller 25 modulates the by-pass valve 26 open, which is provided to by-pass water from the central water supply piping 19 through the by-pass pipe 20 into the central water supply tank 11. The opposite occurs on a decrease in water pressure in the central water supply piping 19.

Chill water pump 15 and water chiller 16 are started on a demand signal from the dew point controller 27. The water pump 15, water chiller 16, and pipes 18 and 38 collectively represent a means for cooling the water in the central water supply piping 19 that is secondary to the central water supply. Water chiller 16 has its own controls to maintain the proper cooling temperature. The pump 15 and common pipe 18 can be eliminated, but this would require the by-pass valve 26 and by-pass pipe 20 to exist and would prevent further reduction in the energy cost required to operate the pump 14.

Chemical feed system 13 maintains its own controls to automatically add chemicals to the water in the central water supply piping 19 or tank 11 so that a consistent chemical treatment level is provided throughout the entire water system and all connected air washers.

On an increase in the water level in the central water supply tank 11, the makeup water valve 36 closes. On a further increase in the water level in the tank 11, water flows into the overflow pipe 35 and goes to the sanitary sewer. The opposite occurs on a decrease in the water level in the tank 11.

As described above, the present invention includes a modulated spray system 21 associated with a central water source 19 separately from a modulated spray system 10 associated with a recirculated water source 9. This means that the modulating of a chilled central water supply 19 to provide cooling and dehumidification is completely decoupled from the modulating of the recirculated water supply 9 to provide cooling and humidification.

During periods when only dehumidifying chill water is required and humidifying recirculating water is not required, recirculating water pump 8 can be turned off, thus saving energy cost. Furthermore, when using a secondary chilled water supply, as the central water source spray system 21 is reduced, the pump 14 is modulated to a slower speed by the pressure controller 25, thus saving even more energy.

During cooler weather periods when chill water is not required, central water source 19 is not cooled and is used to provide the first stage of humidification independently of the recirculated water source 9. This means that during lower heat load periods of the conditioned space 40, recirculated water spray systems 10 can be modulated closed and pump 8 turned off, thus saving more energy cost. Also, pump 8 will automatically start and operate if pump 14 fails. This provides a backup feature which is not available in current air washer system designs. This feature also allows for better preventive maintenance scheduling.

As described above, the present invention uses the central water distribution system 19 for the first stage of spray throttling during the period of time when chill water is not required. This means that the central water distribution system 19 is used throughout the entire year. Thus, the central automatic chemical feed system 13 is used to treat the water for all air washers connected to central water system 19 all year. This also helps to reduce scaling and corrosion in the central water supply piping 19.

There are additional benefits that result from using the central water distribution system 19 for the entire year. These are:

(1) When air washers can gravity drain water to the central tank 11 via the water return weir and drain plug arrangement 3, then the makeup water valve 36 and overflow 35 can be provided only at the central water tank 11. This saves in maintenance, spare parts and reduces the initial cost.

(2) Because air washer water is constantly circulated through the central water tank 11 all year long, central water filtering 37 can be located in the tank 11 as opposed to having to have water filters at each air washer. This allows for lower costs for a better filtration system, reduces maintenance cost, and reduces the initial cost.

In spray throttling air washers with part load room conditions, there is a period of time when the outside air dew point temperature approaches the dew point temperature of the air washer 1 and where outside air dampers 5 are essentially fully open and return air dampers 6 are fully closed. When the outside air is foggy or raining such that its relative humidity is higher than the desired discharge relative humidity, if the air washer 1 passes this higher relative humidity air through the distribution system 22 into the conditioned space 40, heat would be required to maintain the desired psychometric conditions in the conditioned space 40.

The present invention includes a unique control method whereby the conditioned space relative humidity sensor 28, on an increase in relative humidity (it is possible to use a conditioned space temperature sensor on a decrease in temperature), sends a signal to override the dew point (specific humidity) discharge controller 27 through the low signal selector 32 to modulate the outside air dampers 5 closed and to modulate the return air dampers 6 open. This provides a means of maintaining the desired psychometric conditions in the conditioned space 40 without requiring the use of heat, regardless of whether the central water system 19 is providing water for dehumidification or humidification and regardless of the psychometric conditions of the outside air.

The present invention also allows precise control of the psychometric conditions in the conditioned space 40 by use of only the space humidity controller 28. In many process environments, such as the cotton textile industry, it is more important to provide the desired space relative humidity in lieu of temperature in the event that both cannot be maintained. This would be the case, for example, when chill water is needed for dehumidification but is unavailable.

The present invention, under partial heat load conditions of the conditioned space 40, allows for the control of relative humidity while limiting a temperature rise in the conditioned space 40 to a lower level than if conventional air washer or traditional spray throttling air washer controls were utilized.

For example, consider an air washer system designed to maintain 75° F. and 50% relative humidity in the conditioned space 40 at design heat load conditions. The air washer discharge conditions of a good performance air washer would be 56° F. dry bulb temperature and 55½° F. wet bulb temperature. This would place the dry bulb temperature of the conditioned space 40 19½° F. above the air washer discharge air wet bulb temperature. Now consider the same air washer operating at a time when outside air conditions are 80° F. dry bulb temperature and 69° F. wet bulb temperature, refrigeration is unavailable, and the sensible load in the conditioned space 40 is about 25% of the design load (5° F. sensible heat gain). A traditionally controlled air washer with space temperature only control would maintain 75° F. in the conditioned space 40, but the relative humidity of the conditioned space 40 would rise to 80% RH. A traditionally controlled air washer with a high limit humidistat (set at 55% RH) would add washer bypass air and heat to maintain an elevated relative humidity of the conditioned space 40 of 55% RH, but the temperature of the conditioned space 40 would rise to approximately 87° F. The present invention maintains a precise relative humidity of the conditioned space 40 of 50% RH at a cooler temperature of the conditioned space 40 of approximately 84° F. while using no heat.

The present invention not only maintains relative humidity conditions of the conditioned space 40 desired for good process control, but does so at a lower temperature of the conditioned space 40 when chill water is not available. This provides better people comfort and increased energy savings.

For cases in which latent heat gain or loss in the conditioned space 40 is not negligible, the present invention has the dew point (specific humidity) sensor 39 in the conditioned space 40 that resets the set point of the discharge air dew point controller 27 to compensate for latent heat gains and losses in the conditioned space 40. This provides stable control of the psychometric conditions of the conditioned space 40 by varying the dew point temperature of the discharge air from the air washer 1 which does not require increases or decreases in the saturation of the recirculation spray system 10. Additionally, because of the ability of the present invention to separately throttle the central spray water source 19 and the recirculation spray water source 9 and of the unique ability for room relative humidity control 28 to override dew point control 27 of outside air dampers 5 and return air dampers 6, control of the psychometric conditions of the conditioned space 40 is achieved without the use of heat, even with changes in latent heat loads of the conditioned space 40.

It will be appreciated that the present invention is not limited to the exact construction that has been described above and illustrated in the accompanying drawings, and that various modifications and changes can be made without departing from the scope and spirit thereof. For example, an air conditioning system with most of the key features of the present invention can be constructed without the central water by-pass piping 20, the by-pass control valve 26, the recirculating spray water control valve 29, or the dew point sensor 39. It is therefore intended that the scope of the invention only be limited by the appended claims.

The invention claimed is:

1. An air conditioning system for providing precise psychometric conditions in an air conditioned space, comprising:

a means for providing an air flow into said air conditioned space;

a first modulated spray system associated with a central water source for cooling and humidifying or dehumidifying said air flow;

a second modulated spray system associated with a recirculated water source for cooling and humidifying said air flow, said second modulated spray system being separate from said first modulated spray system; and a control means for modulating the water flow rate through the first and second modulated spray systems to selectively cool and humidify or dehumidify said air flow to maintain desired psychometric conditions in said air conditioned space.

2. The air conditioning system according to claim 1, further comprising a recirculating water pump for pumping water from said recirculated water source to said second modulated spray system, and means for slowing or turning off said recirculating water pump when humidifying recirculating water is not required to maintain said desired psychometric conditions.

3. The air conditioning system according to claim 1, further comprising a water chiller associated with said central water source for cooling the water supplied to said first modulated spray system.

4. The air conditioning system according to claim 3, further comprising a means for controlling said water chiller to cool the water supplied to said first modulated spray system when dehumidification of said air flow is required to maintain said desired psychometric conditions.

5. The air conditioning system according to claim 1, further comprising a plurality of air washers, each of said air washers comprising a first modulated spray system and a second modulated spray system, said first modulated spray systems all being in fluid communication with said central water source.

6. The air conditioning system according to claim 5, further comprising a central chemical feed system for treating the water supplied to said first modulated spray systems.

7. The air conditioning system according to claim 5, further comprising a water return arrangement associated with each of said first modulated spray systems for allowing water to drain by gravity from all of said first modulated spray systems to said central water source.

8. The air conditioning system according to claim 7, wherein said central water source comprises a central tank provided with a makeup water valve and an overflow to maintain a desired level of water in said central tank.

9. The air conditioning system according to claim 7, further comprising a central water filtering means located in the central tank for filtering the water supplied to all of said first modulated spray systems.

10. The air conditioning system according to claim 1, further comprising:

a specific humidity sensor for generating a first signal indicative of specific humidity in the air flow;

a relative humidity sensor for generating a second signal indicative of relative humidity in the air conditioned space; and an actuator means for selectively modulating an outside air damper and a return air damper open and closed based on said first and second signals.

11. The air conditioning system according to claim 10, further comprising a low signal selector means for allowing the second signal from the relative humidity sensor to override the first signal from the specific humidity sensor upon an increase in relative humidity in the air conditioned space above a set level, whereupon the outside air damper is modulated closed and the return air damper is modulated open.

12. The air conditioning system according to claim 1, further comprising:

an outside air damper;

a return air damper;

a first specific humidity sensor for generating a first signal indicative of specific humidity in the air flow;

a second specific humidity sensor for generating a second signal indicative of specific humidity in the air conditioned space;

means for controlling the first and second modulated spray systems, the outside air damper, and the return air damper to dehumidify the air flow when said first signal is above a set point; and means for adjusting said set point based on said second signal to compensate for latent heat gains and losses in the air conditioned space.

13. The air conditioning system according to claim 1, further comprising:

an outside air damper for regulating a flow of air into said air conditioning system from outside;

a return air damper for regulating a flow of air into said air conditioning system from inside the air conditioned space;

a water chiller associated with said central water source for cooling the water supplied to said first modulated spray system;

a specific humidity sensor for generating a first signal indicative of a specific humidity of said air flow;

means for modulating the outside air damper open and the return air damper closed when said first signal indicates a rise in specific humidity above a set point;

means for starting the water chiller to cool the water supplied to said first modulated spray system upon a further rise in specific humidity; and means for detecting whether the water supplied to the first modulated spray system is cold enough to dehumidify the air flow and, if so, for increasing the water flow in the first modulated spray system upon a further rise in specific humidity.

14. The air conditioning system according to claim 13, further comprising:

a relative humidity sensor for generating a second signal indicative of a relative humidity in said air conditioned space;

a low signal selector means for allowing the second signal from the relative humidity sensor to override the first signal from the specific humidity sensor upon an increase in relative humidity in the air conditioned space;

means for slowing or stopping a water flow through said second modulated spray system when said second signal indicates a rise in relative humidity in said air conditioned space above a set point;

means for detecting whether the water supplied to the first modulated spray system is not cold enough to dehumidify the air flow and, if it is not, for decreasing the water flow in the first modulated spray system when said second signal indicates a further rise in relative humidity in said air conditioned space; and means for modulating the outside air damper closed and the return air damper open when said second signal indicates a further rise in relative humidity in said air conditioned space.

15. An air conditioning system for providing precise psychometric conditions in an air conditioned space, comprising:

a means for providing an air flow into said air conditioned space;

a first modulated spray system associated with a central water source for cooling and humidifying or dehumidifying said air flow;

a second modulated spray system associated with a recirculated water source for cooling and humidifying said air flow said second modulated spray system being separate from said first modulated spray system;

a control means for modulating the first and second modulated spray systems to selectively cool and humidify or dehumidify said air flow to maintain desired psychometric conditions in said air conditioned space; and a central water pump for pumping water from said central water source to said first modulated spray system, and means for slowing or stopping said central water pump when dehumidifying central water is not required to maintain said desired psychometric conditions.

16. An air conditioning system for providing precise psychometric conditions in an air conditioned space, comprising:

a means for providing an air flow into said air conditioned space;

a first modulated spray system associated with a central water source for cooling and humidifying or dehumidifying said air flow;

a second modulated spray system associated with a recirculated water source for cooling and humidifying said air flow, said second modulated spray system being separate from said first modulated spray system;

a control means for modulating the first and second modulated spray systems to selectively cool and humidify or dehumidify said air flow to maintain desired psychometric conditions in said air conditioned space;

a water chiller associated with said central water source for cooling the water supplied to said first modulated spray system; and a means for preventing said water chiller from cooling the water supplied to said first modulated spray system during cold outside weather periods.

17. The air conditioning system according to claim 16, further comprising:

a central water pump for pumping water from said central water source to said first modulated spray system;

a recirculating water pump for pumping water from said recirculated water source to said second modulated spray system; and a means for controlling said first modulated spray system to humidify said air flow using said central water source and for slowing or stopping said recirculating water pump during cold outside weather periods, whereby said recirculating water pump is available as a backup pump during maintenance or failure of said central water pump.

18. A method for providing precise psychometric conditions in an air conditioned space, comprising the steps of:

providing an air flow into said air conditioned space;

providing a first modulated spray system associated wit a central water source for cooling and humidifying or dehumidifying said air flow;

providing a second modulated spray system associated with a recirculated water source for cooling and humidifying said air flow, said second modulated spray system being separate from said first modulated spray system; and modulating the water flow rate through the first and second modulated spray systems to selectively cool and humidify or dehumidify said air flow to maintain desired psychometric conditions in said air conditioned space.

19. The method according to claim 18, further comprising the steps of:

providing an outside air damper for regulating a flow of air into said air conditioning system from outside;

providing a return air damper for regulating a flow of air into said air conditioning system from inside the air conditioned space;

providing a water chiller associated with said central water source for cooling the water supplied to said first modulated spray system;

generating a first signal indicative of a specific humidity of said air flow;

modulating the outside air damper open and the return air damper closed when said first signal indicates a rise in specific humidity above a set point;

starting the water chiller to cool the water supplied to said first modulated spray system upon a further rise in specific humidity; and detecting whether the water supplied to the first modulated spray system is cold enough to dehumidify the air flow and, if so, increasing the water flow in the first modulated spray system upon a further rise in specific humidity.

20. The method according to claim 19, further comprising the steps of:

generating a second signal indicative of a relative humidity in said air conditioned space;

slowing or stopping a water flow through said second modulated spray system when said second signal indicates a rise in relative humidity in said air conditioned space above a set point;

detecting whether the water supplied to the first modulated spray system is not cold enough to dehumidify the air flow and, if it is not, decreasing the water flow in the first modulated spray system when said second signal indicates a further rise in relative humidity in said air conditioned space; and modulating the outside air damper closed and the return air damper open when said second signal indicates a further rise in relative humidity in said air conditioned space.

21. An air conditioning system for providing precise psychometric conditions in an air conditioned space, comprising:

an air supply mechanism for providing an air flow through a common chamber into said air conditioned space;

a first modulated spray system associated with a chilled water some for cooling and humidifying or dehumidifying said air flow within said common chamber;

a second modulated spray system associated with a recirculated water source for cooling and humidifying said air flow within said common chamber, said second modulated spray system being separate from said first modulated spray system; and a control means for modulating the water flow rate through the first and second modulated spray systems independently from one another to selectively cool and humidify or dehumidify said air flow within said common chamber to maintain desired psychometric conditions in said air conditioned space.

* * * * *